United States Patent [19]

Luedtke et al.

[11] 4,007,461

[45] Feb. 8, 1977

[54] ANTENNA SYSTEM FOR DERIVING CARDIOD PATTERNS

[75] Inventors: Arthur Luedtke, Marietta; William L. Kilpatrick, Austell, both of Ga.

[73] Assignee: Field Operations Bureau of the Federal Communications Commission, Washington, D.C.

[22] Filed: Sept. 5, 1975

[21] Appl. No.: 610,717

[52] U.S. Cl. ..... 343/844; 343/113 R; 343/853

[51] Int. Cl.[2] ..... H01Q 21/06

[58] Field of Search ..... 343/113 R, 844, 852, 343/854, 853

[56] References Cited

UNITED STATES PATENTS

| | | | |
|---|---|---|---|
| 3,226,724 | 12/1965 | Brueckmann | 343/854 |
| 3,396,398 | 8/1968 | Dunlavy | 343/844 |
| 3,683,385 | 8/1972 | Corzine et al. | 343/113 R |

*Primary Examiner*—Eli Lieberman
*Attorney, Agent, or Firm*—Wm. Ferrel Bentley

[57] ABSTRACT

An Isolation Differential Combiner which accepts signals from two spaced vertical whip antenna elements and which are then combined through delay lines so that the resulting said reception pattern is a cardioid signal pattern at the combiner outputs. The isolation of the two signals is accomplished by connecting wide-band balanced transformers as hybrids. The differential component of the two signals present at the hybrid combiner is available at each secondary winding of each wide-band balanced transformer.

5 Claims, 1 Drawing Figure

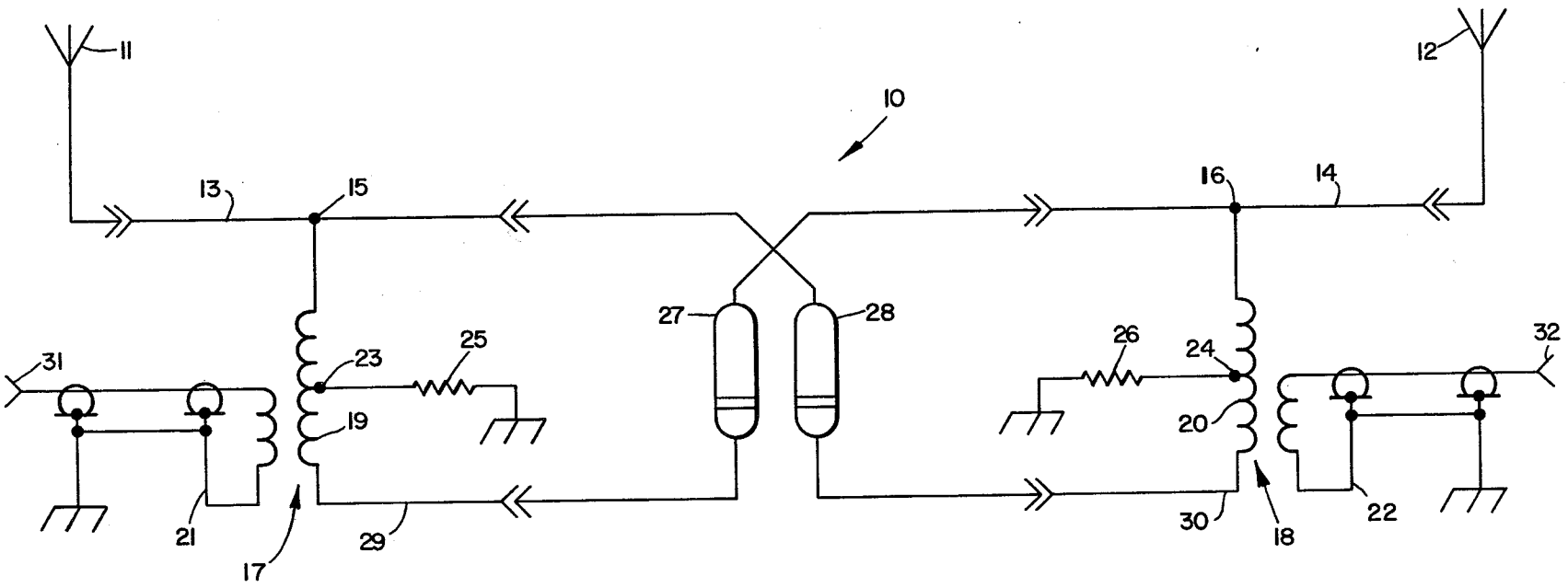
10
11
12
13
14
15
16
17
18
19
20
21
22
23
24
25
26
27
28
29
30
31
32

ANTENNA SYSTEM FOR DERIVING CARDIOD PATTERNS

BACKGROUND OF THE INVENTION

1. Field of the Invention

The present invention relates to an isolation differential combiner and more particularly to an isolation network for plural antennas spaced apart from each other.

2. Description of the Prior Art

The concept of combining two spaced antennas with a delay line system to provide a cardioid pattern of reception or transmission is well known. In general, such systems provide a fixed delay on a non-differential basis so that the desired pattern is obtained but results in a frequency dependent system. Such systems have no provision for providing reciprocal patterns in opposing directions. The present invention overcomes the disadvantages of such systems in that it provides pattern formation with opposing cardioids available from separate output ports, and in addition, provides such patterns simultaneously without interaction and on a frequency independent basis.

SUMMARY OF THE INVENTION

The general purpose of this invention is to provide an isolation differential combiner for use with receiving systems, particularly direction finding receiving systems. An object of the present invention is the provision of isolating one antenna from the other antenna. Another object is to provide an isolation differential combiner that is not frequency sensitive by using a wide band balanced transformer connected in a hybrid configuration. A further object of the invention is the provision of having two vertical whip antenna elements or other omnidirectional antenna elements used in combination with the isolation differential combiner and suitable delay lines result in a bidirectional cardioid receiving pattern. Still another object is to provide a wide-band balanced transformer connected in a hybrid configuration so that the output on each secondary winding is the differential of the signals received by the two vertical whip antenna elements.

BRIEF DESCRIPTION OF THE DRAWING

Other objects and many of the attendant advantages of this invention will be readily appreciated as the same becomes better understood by reference to the following detailed description when considered in connection with the accompanying drawing, in which like reference numerals designate like parts throughout the figures thereof and wherein The FIGURE is a schematic circuit diagram of the invention.

DESCRIPTION OF THE PREFERRED EMBODIMENTS

The FIGURE is a schematic diagram of the circuit for the isolation differential combiner 10. A left antenna 11 and right antenna 12 are connected respectively to the left antenna input 15 through transmission line 13 and right antenna input 16 through transmission line 14. The antenna may be vertical whip antenna elements or any other suitable omnidirectional antenna elements. The overall lengths of the transmission lines 13 and 14 are not critical to the operation of this invention but the lengths of each transmission line have to be equal; that is, the length of line 13 equals the length of line 14 for proper operation. The primary winding 19 of wide-band balanced transformer 17 is connected from left antenna input 15 to a bottom port 29. The secondary winding 21 of transformer 17 is connected to left antenna output 31. The primary winding 20 of wide-band balanced transformer 18 is connected from right antenna input 16 to a bottom port 30. The secondary winding 22 of transformer 18 is connected to the right antenna output 32. A resistor 25 is connected from the center tap 23 of the primary winding 19 of wide-band balanced transformer 17 to ground. A resistor 26 is connected from the center tap 24 of the primary winding 20 of the wide-band balanced transformer 18 to ground. Resistors 25 and 26, when used in conjunction with wide-band balanced transformers 17 and 18 form hybrid circuits to isolate a top port from the bottom port of the primary windings 19 and 20 of the transformers 17 and 18 respectively. The isolation of the two signal components from the left antenna 11 and the right antenna 12 is accomplished by connecting the wide-band balanced transformers 17 and 18 as hybrids. The differential component of the two signals present at the hybrid combiner is available at the secondary windings 21 and 22 of the wide-band balanced transformers 17 and 18 respectively. The wide-band balanced transformers 17 and 18 when used as a hybrid combiner requires the use of delay lines which match the separation of the antenna elements and provide proper phase delay for formation of cardioid signal patterns at the output of the combiner system.

A delay line 27 is connected from right antenna input 16 to bottom port 29 of primary winding 19 of wide-band balanced transformer 17. A delay line 28 is connected from left antenna input 15 to bottom port 30 of primary winding 20 of wide-band balanced transformer 18. Therefore, left antenna 11 is connected to left antenna input 15, also the top port of primary winding 19, and delay line 28 from the right antenna, also the top port of primary winding 20, is connected to the bottom port 29 of the wide-band balanced transformer 17 delaying the right antenna signal into the transformer resulting in a differential component which shows up in the primary winding 19 of the transformer 17. The resistor 25 connected at the center tap 23 of primary winding 19 turns the wide-band balanced transformer 17 into a hybrid resulting in isolation between opposite top and bottom port ends 15 and 29 of the transformer 17. Ideally, the isolation between the opposite top and bottom port ends 15 and 29 of the wide-band balanced transformer 17 should be infinite but in reality there is about 20 to 30 decibels isolation between the opposite, top and bottom, port ends. Since the disclosed system is symmetrical with respect to the left and right antenna 11 and 12 respectively, the same isolation conceptual theory applies to the opposite, top and bottom, port ends 16 and 30 of the primary winding 20 of the wide-band balanced transformer 18. Since the opposite, top and bottom, ports on each primary winding of each wide-band balanced transformer 17 and 18 are isolated from each other, then the left and right antennas 11 and 12 are isolated from each other. The length of the delay lines 27 and 28 is a direct function of the spacing of the left 11 and right 12 antennas modified by the velocity factor of the delay line. The delay lines can either be two separate pieces of coaxial cable such as by way of example RG-174/U which is miniature coaxial cable or a twisted pair of wires contained in a shielded outer conductor cable jacket such as phono pickup cable. The only limiting factor of the delay lines is the physical size of cable used for the lines with respect to the physical structure housing the isolation differential combiner. The delay lines may be enclosed in the differential combiner housing or may be connected externally depending upon physical size and operational circumstances.

PREFERRED MODE OF OPERATION

When a transmitted signal component received, it will be received first by either left antenna 11 or right antenna 12. For way of example and by way of illustration, if the transmitted signal is received by left antenna 11, then the reception may be delayed in space at the right antenna 12 by 30°. Delay line 27 from right antenna 12 also has a 30° delay to bottom port 29 of primary winding 19 of wide-band balanced transformer 17. Therefore, when the transmitted signal from right antenna 12 reaches the bottom port 29 of transformer 17, it has a 60° delay with respect to the signal at top port 15 of transformer 17 from left antenna 11. The wide-band balanced therefore has two signals on it, the signal from left antenna 11 at 0° phasing and the signal from the right antenna at −60° phasing. The characteristic of the hybrid transformer is such that two vector inputs having differing phase angles will result in an output from the secondary port which is a direct function of the vectorial phase difference. The same signal that was received at the left antenna 11 will have a 30° phase shift delay after it goes through delay line 28 and reaches bottom port 30 of wide-band balanced transformer 18. When right antenna 12 receives the signal, it also has a 30° phase shift delay with respect to left antenna 11. Therefore, the signal at right antenna 12 and the bottom port 30 of wide-band balanced transformer 18 are equal phased signals each one having a 30° delay resulting in no output at the secondary winding 22 of transformer 18. With equal phase signals at the top and bottom ports, there is no output in transformer 18. Therefore, the received signal results in an output at transformer 17 but not in transformer 18. Thus, the received signal output is undirectional with a cardioidal azimuth pattern in that there is output at the left antenna output 31, but zero output at the right antenna output 32. Moreover, the system operates bidirectionally in that if the signal is received at right antenna 12 first, then the principles of the previous discussion are reversed in that secondary winding 22 of wide-band balanced transformer 18 will have an output at port 32 while the secondary winding 21 of transformer 17 will have zero output at port 31. If the signals reach left and right antennas, 11 and 12 respectively, at the same time, then the outputs at the left and right antenna output, 31 and 32 respectively, will be equal as the antennas are equally distant from the radio frequency signal source and arrive at the same point on the curve of the two cardioids. The left antenna output 31 and right antenna output 32 are connected to a suitable direction finding signal processing system which will drive a directional indicator device.

The isolation differential combiner isolates two vertical whip antennas while combining the two signals to obtain the two differential cardioidal patterns. The turn ratio of wide-band balanced transformers 17 and 18, the resistances of resistors 25 and 26, and the length and impedance of the delay lines 27 and 28 all interact to determine the component values with respect to the spacing and impedance of the two vertical whip antennas 11 and 12.

Various modifications are contemplated and may obviously be resorted to by those skilled in the art without departing from the spirit and scope of the invention, as hereinafter defined by the appended claims, as only a preferred embodiment thereof has been disclosed.

Transmission lines 13 and 14 can be coaxial transmission line or any other suitable substitute. Right antenna output 32 connected to secondary winding 22 of transformer 18 can either be a direct electrical connection or a connection through a coaxial transmission line as is shown in the drawing. The same applies to left antenna output 31.

What is claimed and desired to be secured by Letters Patents of the United States is:

1. An isolation differential combiner comprising a left omnidirectional antenna input, a left antenna output, left transformer means having a primary and secondary winding connected therebetween, a right omnidirectional antenna input, a right antenna output, right transformer means having a primary and secondary winding connected therebetween, and each of said transformer means being centertapped for hybrid isolation between opposite ports of said primary, and delay line means crossconnecting said antenna inputs and said transformer primary means resulting in a cardioid signal pattern at said left and right antenna outputs.

2. The isolation differential combiner of claim 1 wherein each of said transformer means are wide balanced transformers.

3. The isolation differential combiner of claim 2 wherein each of said delay lines has a delay which match the separation of the said antenna elements.

4. The isolation differential combiner of claim 1 wherein each of said secondary of said transformer means has a resistor connected to ground.

5. The isolation differential combiner of claim 4 wherein the received signal output at the secondary of each transformer is unidirectional with a cardioid azimuth pattern and in opposing directions.

* * * * *